US007036502B2

(12) United States Patent
Manne

(10) Patent No.: US 7,036,502 B2
(45) Date of Patent: May 2, 2006

(54) AIR CURTAIN DEVICE

(76) Inventor: Joseph Manne, 920 Park Ave., New York, NY (US) 10016

( * ) Notice: Subject to any disclaimer, the term of this patent is extended or adjusted under 35 U.S.C. 154(b) by 0 days.

(21) Appl. No.: 10/408,685

(22) Filed: Apr. 7, 2003

(65) Prior Publication Data

US 2003/0188743 A1 Oct. 9, 2003

Related U.S. Application Data

(60) Provisional application No. 60/370,880, filed on Apr. 8, 2002.

(51) Int. Cl.
*A62B 29/00* (2006.01)
*A62B 37/00* (2006.01)
*F24F 13/00* (2006.01)

(52) U.S. Cl. ..... 128/200.28; 128/200.27; 128/201.22; 2/171; 2/171.3

(58) Field of Classification Search ..... 128/201.22, 128/202.26, 204.22, 200.28, 204.18, 200.24, 128/200.27; 2/410, 4, 424, 171.2, 171.3, 2/173, 184.5
See application file for complete search history.

(56) References Cited

U.S. PATENT DOCUMENTS 2,032,101 A 2/1936 Sullivan
2,333,054 A * 10/1943 Sullivan ..... 128/200.27
2,560,215 A 7/1951 Christensen
3,683,907 A * 8/1972 Cotabish ..... 128/200.28
3,736,927 A 6/1973 Misaqi
3,881,198 A 5/1975 Waters
3,881,478 A 5/1975 Rosendahl et al.
3,921,223 A * 11/1975 Hoyecki ..... 2/8
4,195,363 A 4/1980 Jenson
4,227,520 A 10/1980 Lord
4,282,869 A * 8/1981 Zidulka ..... 128/200.28
4,571,741 A 2/1986 Guillaumot
5,002,049 A 3/1991 Knoll
5,035,239 A 7/1991 Edwards
5,046,492 A 9/1991 Stackhouse et al.
5,054,479 A 10/1991 Yelland et al.
5,054,480 A 10/1991 Bare et al.
5,104,430 A * 4/1992 Her-Mou ..... 55/385.1
5,109,839 A * 5/1992 Blasdell et al. ..... 128/203.12
5,123,114 A * 6/1992 Desanti ..... 2/8
5,125,402 A 6/1992 Greenough
5,200,736 A 4/1993 Coombs et al.
5,353,605 A * 10/1994 Naaman ..... 62/259.3
5,410,757 A 5/1995 Vienamo et al.
5,425,620 A 6/1995 Stroud
5,513,632 A 5/1996 Nepon et al.
5,561,862 A * 10/1996 Flores, Sr. ..... 2/171.3
5,865,175 A * 2/1999 Chu ..... 128/205.22
RE36,242 E * 6/1999 Apisdorf ..... 62/3.7
6,014,971 A 1/2000 Danisch et al.
6,032,291 A 3/2000 Asenguah et al.
6,065,473 A * 5/2000 McCombs et al. ..... 128/204.18
6,119,689 A 9/2000 Korman
6,125,845 A 10/2000 Halvorsen et al.

(Continued)

*Primary Examiner*—Henry Bennett
*Assistant Examiner*—Amanda Wieker
(74) *Attorney, Agent, or Firm*—Lucas & Mercanti, LLP

(57) ABSTRACT

The device for creating a curtain of air across the face is a headset with a fan mounted thereon. The outlet of the fan has flexible tubing or cowling which allows for control of both direction and cross section of a curtain of air that crosses the face. The curtain of air prevents airborne particles and chemicals from making contact with the face.

13 Claims, 4 Drawing Sheets

U.S. PATENT DOCUMENTS

| | | | | |
|---|---|---|---|---|
| 6,192,702 | B1 | 2/2001 | Shimogori | |
| 6,247,470 | B1 * | 6/2001 | Ketchedjian | 128/200.28 |
| 6,279,572 | B1 | 8/2001 | Danisch et al. | |
| 6,302,105 | B1 | 10/2001 | Wickham et al. | |
| 6,409,338 | B1 | 6/2002 | Jewell | |
| 6,450,166 | B1 * | 9/2002 | McDonald et al. | 128/206.27 |
| 6,752,146 | B1 * | 6/2004 | Altshuler et al. | 128/201.25 |
| 2003/0154983 | A1 * | 8/2003 | Marx | 128/205.27 |
| 2004/0055601 | A1 * | 3/2004 | De Luca et al. | 128/205.22 |
| 2005/0061316 | A1 * | 3/2005 | Manne | 128/200.27 |

* cited by examiner

AIR CURTAIN DEVICE

CROSS-REFERENCE TO RELATED APPLICATIONS

This application claims the priority of U.S. Provisional patent application Ser. No. 60/370,880 filed Apr. 8, 2002.

BACKGROUND OF THE INVENTION

1. Field of the Invention

The present invention relates to a device that shields the face of a human being from airborne particles.

2. Art Relating to the Invention

Airborne particles which float on the currents in the air are well known. Typically, such airborne particles are referred to as odors or smoke. Airborne particles can also include microbes such as allergins, viruses and bacteria which cause diseases. For example, the bacterium that causes tuberculosis and anthrax is carried by air.

Conventionally, a mask is worn to shield the face and prevent these airborne particles and/or chemicals from making contact with the face of a human being. Such face masks cover either the nose and the mouth or, in more drastic situations, the full face of the individual.

These face masks have the drawback that they are sometimes difficult to put on and restrict the wearer. There is a need for a simpler device for protection of the face from airborne chemicals and particles.

SUMMARY OF THE INVENTION

A simple device has now been discovered for protecting the face from airborne particles and chemicals. The device of the present invention is simple to wear and does not restrict the user.

Broadly, the present invention produces a flow or curtain of air across the human face in order to block or divert airborne particles and chemicals, which may be in the air, from making contact with the face and, more specifically, the mouth and nose. The device of the present invention is worn by the user and has a means, such as a fan, for generating the shield of air.

More specifically, the apparatus of the present invention can be defined as a portable device which comprises:

(a) a support means adapted to be worn by a user on a head, shoulder or neck of the user; and (b) an air flow means for generating and directing a flow of air across a face of a user, said air flow means affixed to said support thereby making said device portable.

Preferably, the air flow is directed from the side of the face so as to direct the flow of air across the face, however, it can also be directed from below the face.

Suitably, the air flow means comprises a generating means for producing a volume of moving air and a directing means for pointing the air flow across the face. Suitable generating means include a fan with a power source or a canister of compressed air. Suitable power sources include batteries, solar cells, and winding springs. Generating means should generate a flow of air across the face of greater than or equal to (≧) about 10 cubic feet/minute (30 liters/minute) as a minimum and, more preferably, about 15 to 20 cubic feet/minute (45 to 60 liters/minute). Although the volume of air used in the present invention can be higher, the size of the fan becomes unmanageable.

The directing means for directing air flow includes cowling, baffling, piping or tubing having an inlet connected to an outlet of said generating means and having an outlet in close proximity to the face which allows for adjustment of the direction of flow of air across the face. Preferably, tubing is employed which is flexible to allow for adjustment of the shape of the cross section of the air flow and/or the direction of the air flow across the face. More preferably, the tubing has multiple outlet jets to allow for more complete adjustment of the air flow across the face and the possibility of creating multiple curtains of air in front of the face.

Suitably, support means include head gear such as a hat, a headset-like device, a shoulder harness, or a chest harness. The directing means and, optionally, the generating means are mounted on a single support. The generating means can be worn on the hip or over the shoulder of the wearer using a shoulder bag or a belt clip as a support while the directing means is mounted on head gear as a support. The device must be portable and must function while the user moves about so as not to interfere with the wearer of the device. The device of the present invention can also be worn about the neck of the user. Suitable headsets include the type typically found in the communication field.

Preferably, a filter is associated with the air flow means to filter the air before it crosses the face of the user.

It is also preferred that a detector is associated with the device to detect the presence of unwanted particles and chemicals which may have either entered the curtain of air as it travels across the face.

It is also preferred that an air conditioning unit, such as a dehumidifier, a humidifier, irradiation source or a fragrance source, be associated with the device so that it can affect the air as it travels across the face. It will be noted that the current of air contacts the face. A dehumidifier removes water from the air flow while a humidifier adds water to the air flow.

The term "across the face" as used herein means that the curtain of air has a generally horizontal direction that is from less than 90° to more than 0°, where 90° is normal to the plane of the face and 0° is parallel to the plane of the face.

Preferably, the air curtain emanates from the side of the face and said directing means is positioned at the side of the face.

The term "side of the face" as used herein means that the air flow is directed from either ear rather than from above or below the face, taken on a vertical axis from greater than 0° to less than 180°.

It is preferred that the center of the flow of air across the face is spaced a distance of about 0 to about 20 cm from the face. Since the air flow as it leaves the air flow means expands to form a conical cross section, the air flow will contact the face as it crosses the face.

The flow of air has a cross section which is, in part, dictated by the shape of the outlet of the directing means.

BRIEF DESCRIPTION OF THE DRAWINGS

These and other aspects of the present Invention may be more fully understood by reference to one or more of the following drawings wherein.

DETAILED DESCRIPTION OF THE INVENTION

Figure 1:
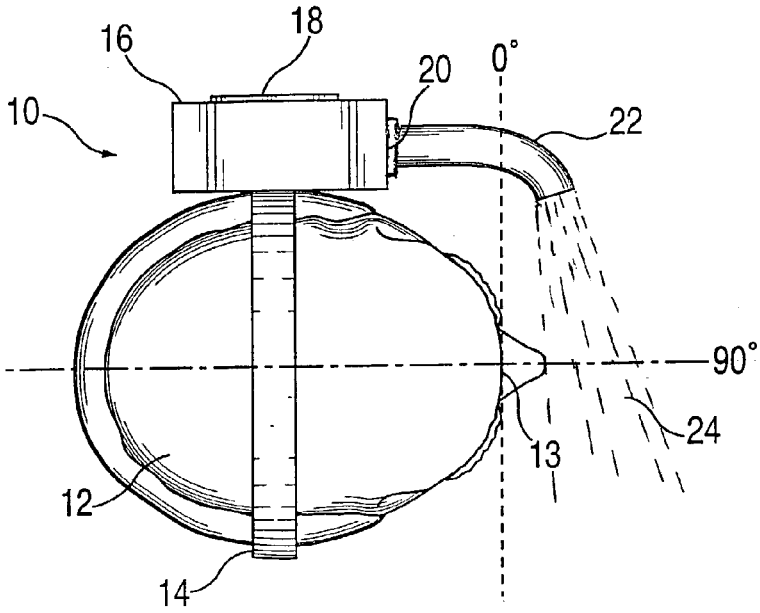
FIG. 1 is a top view of the head of a human wearing the device of the present invention.

Turning to FIG. 1, device 10 of the present invention is worn on head 12 of a human being. Device 10 comprises headset 14 to which is mounted fan 16. Fan 16 has inlet 18 and outlet 20. Fixed to outlet 20 is flexible tubing 22. Outlet 20 has a manifold to mate square outlet 20 to circular tubing 22. Fan 16 with tubing 22 generates a curtain of air 24 across face 13 of the human head 12.

Figure 2:
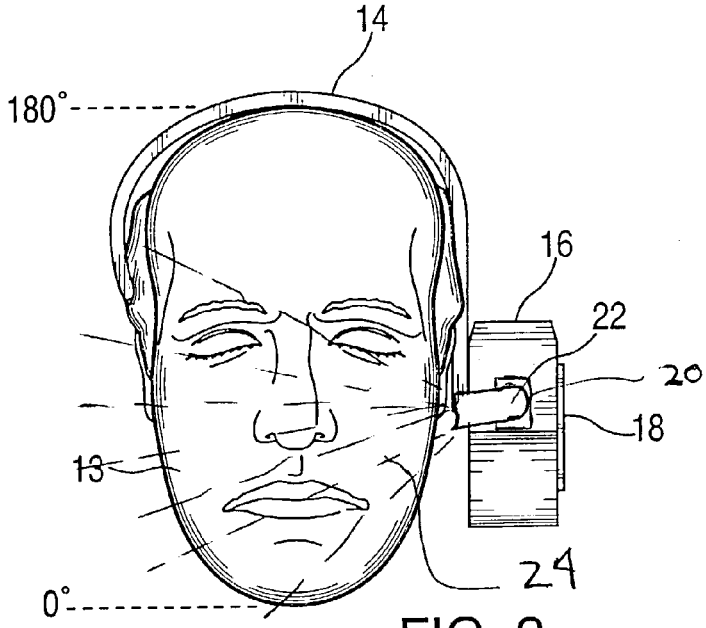
FIG. 2 is a front view of FIG. 1.

The horizontal orientation of the head with respect to the device is shown by the coordinate 0° and 90° in FIG. 1 while the vertical orientation to the head is shown in FIG. 2 by the coordinate 0° to 180°.

In FIG. 2, a front view of face 13 is shown. As will be appreciated, air curtain 24 has a generally conical cross section.

Figure 3:
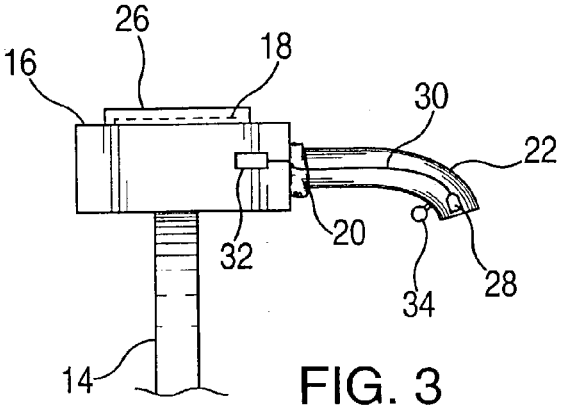
FIG. 3 is a top view of the device of the present invention with a detector.

In FIG. 3, filter 26 is shown covering inlet 18 and detector 28 is shown mounted at the end of flexible tubing 22. Detector 28 is connected by wire 30 alarm 32. An air conditioning device such as radiation generator 34 is mounted on flexible tubing 22 to generate radiation beam in conjunction with the curtain of air. Generator 34 is preferably a UV radiation generator and is positioned inside tube 22 to condition or treat the air before it exits tube 22.

Figure 4:
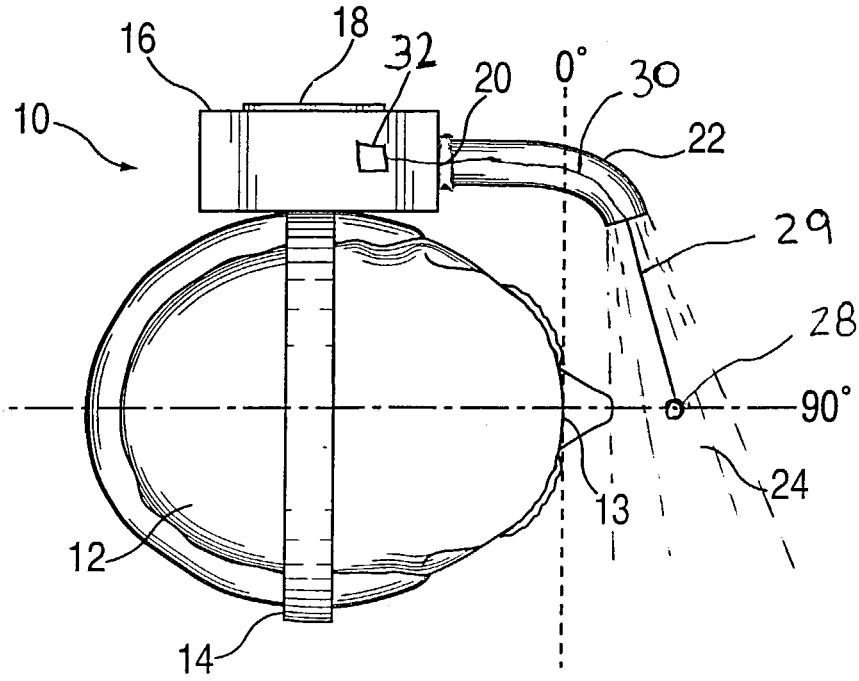
FIG. 4 is a top view of the device with a detector.

FIG. 4 illustrates detector 28 extending out into current of air 24 by means of stiff wire 29. This positions detector 28 at the center of face 13.

Figure 5:
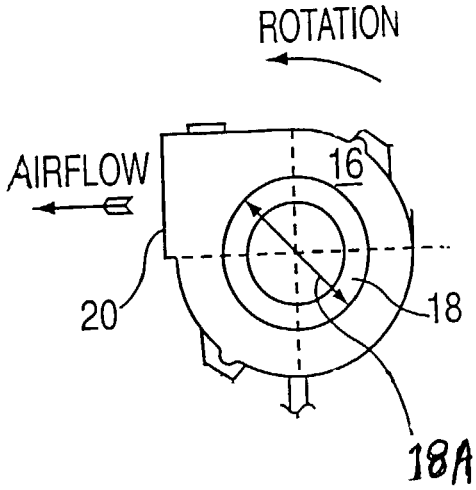
FIG. 5 is a side view of the device.

FIG. 5 details a preferred fan for use in the present invention. It will be appreciated that other types of fans or air moving equipment can be used. It will also be appreciated that such fans are generally electrical in nature and that a battery unit must be either worn as a separate portion and connected to fan 16 or be mounted in association with fan 16 on headset 14. Fan 16 is essentially a square having a dimension of about 3 inches by 3 inches (75 mm×75 mm). Inlet 18 has inlet diameter 18A of about 1.9 inches (48 mm). Outlet 20 of fan 16 is rectangular in shape and measures about 1.2 inches (30 mm) in width and about 1.5 inches (40 mm) in height. Fan 16 operates on direct current, suitably 12 volts, and has a housing made of plastic thereby being lightweight and can be obtained from conventional sources.

The purpose of the present invention is to create a curtain of air from the side of the face which crosses in front of the face. This curtain of air has a velocity which redirects airborne particles and chemicals away from the face. The type of airborne particles and chemicals which it is intended to work against are chemicals such as odors, smoke particles, allergens, airborne microbes, such as viruses and bacteria. Two conventional airborne microbes which are experienced are tuberculosis as well as anthrax viruses and spores.

The curtain of air will cause a redirection of these airborne particles away from the face because of the velocity of the air.

The flexible tubing 22, which is employed with the present invention, is such that, not only the direction of the tubing can be adjusted but, also, the cross sectional shape of the outlet of the tubing. By allowing for adjustment of cross sectional tubing, the cross section of the current of air flow can, likewise, be adjusted. For example, shape of the cross section of the tubing can be adjusted from circular to rectangular to oblong. Thus, the stream of air that crosses the face and, specifically, crosses in front of the nose and mouth, forces airborne particles away from the face. The tubing can be conventional, flexible, corrugated tubing. The outlet of the tubing can flare to allow the user to adjust the dimensions of the air curtain as it leaves the tubing. Generally, the flow of air does not remain rigid but flares as it travels away from the end of the tubing such that it obtains a conical shape.

The fan can be any conventional fan which can generate a current of air and which is light enough to be worn with a headset. One such fan is an in line fan that employs a propeller. The inlet and outlet are in line with the propeller and provide a straight line flow of air through the fan. Such fans have an internal diameter/propeller that measure about 1.5 to about 2.0 inches in diameter.

The inlet of the fan can have a filter mounted on it so as to filter the air which is coming into the fan. Such filters can include HEPA, or can be carbon based.

The fan is preferably adjustable in speed and orientation so that the velocity of the air and the volume of air which travels across the face is adjustable in both amount and direction. The purpose for adjustment is to allow the fan to be adjusted depending on the exterior currents in the air. In other words, on a windy day, the velocity and volume of air which crosses the face should be greater than on a day where the air is still and not moving.

It is preferred that there is a detector which detects the entry of unwanted chemicals and particles in front of the air curtain, in the air curtain or ones that have penetrated the air curtain and warns the user of their presence. Suitably, detector 28 as shown in FIGS. 3 and 4 is connected by wire 30 to an alarm 32. As will be appreciated, since alarm 32 is at the side of the head, it should be an audible alarm. Naturally, the alarm could comprise an earphone which is worn in the ear of the user and is only audible to the user or a light which is positioned in view of the user.

Additionally, alarm 32 can include a microprocessor which increases the speed of the fan which, in turn, increases the volume of air that is directed across the face of the user. Thus, when chemicals or unwanted airborne particles are detected or an increase or decrease of the same are detected, the speed of the fan can be adjusted automatically to compensate for the increase or decrease. An increase of chemicals or particles warrants an increase in air while a decrease in chemicals or particles warrants a decrease in the fan speed.

It is also preferred that the device of the present invention have an air-conditioning, such as a dehumidifier, an ultraviolet source, a radiation source, or fragrance. The purpose of these air-conditioning units is to condition the current of air which flows across the face. For example, FIG. 3 illustrates radiation generator 34 which provides a source of radiation that eliminates or deactivates microbes when they come within the vicinity of the curtain of air.

Figure 6:
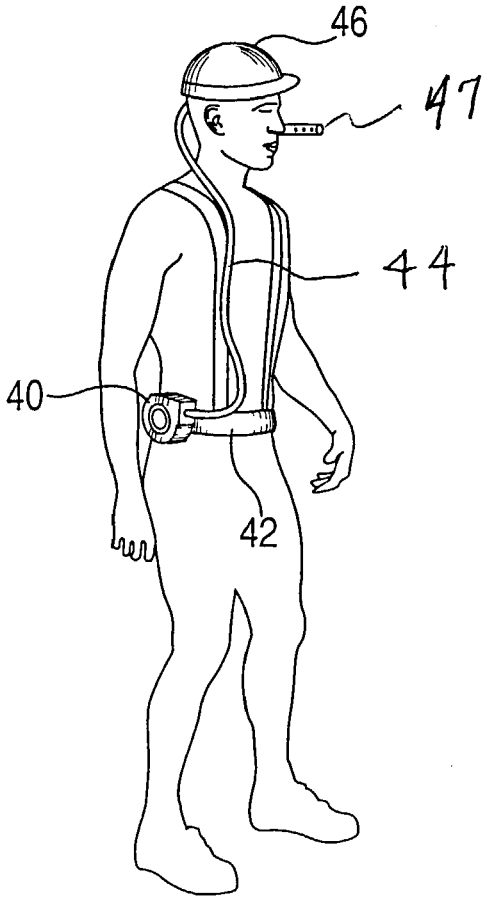
FIG. 6 is a side view of a human wearing the device of the present invention.

In FIG. 6, fan 40 is worn on belt 42. Tubing 44 directs air from the outlet of fan 40 to the side of the face and across the face. Head gear 46 acts as a point of attachment for tubing 44 so that outlet 47 of tubing 44 directs an air flow across the face of the user.

Figure 7:
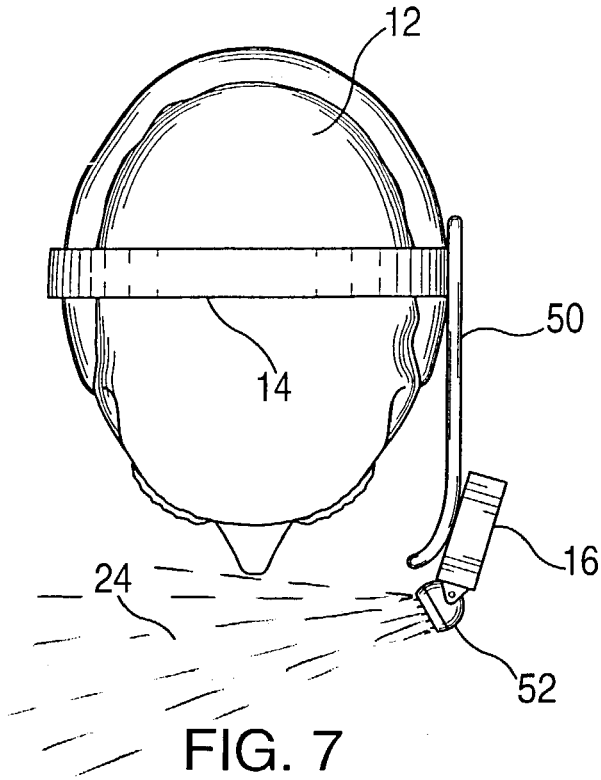
FIG. 7 is a top view of another embodiment of the present invention.
Figure 8:
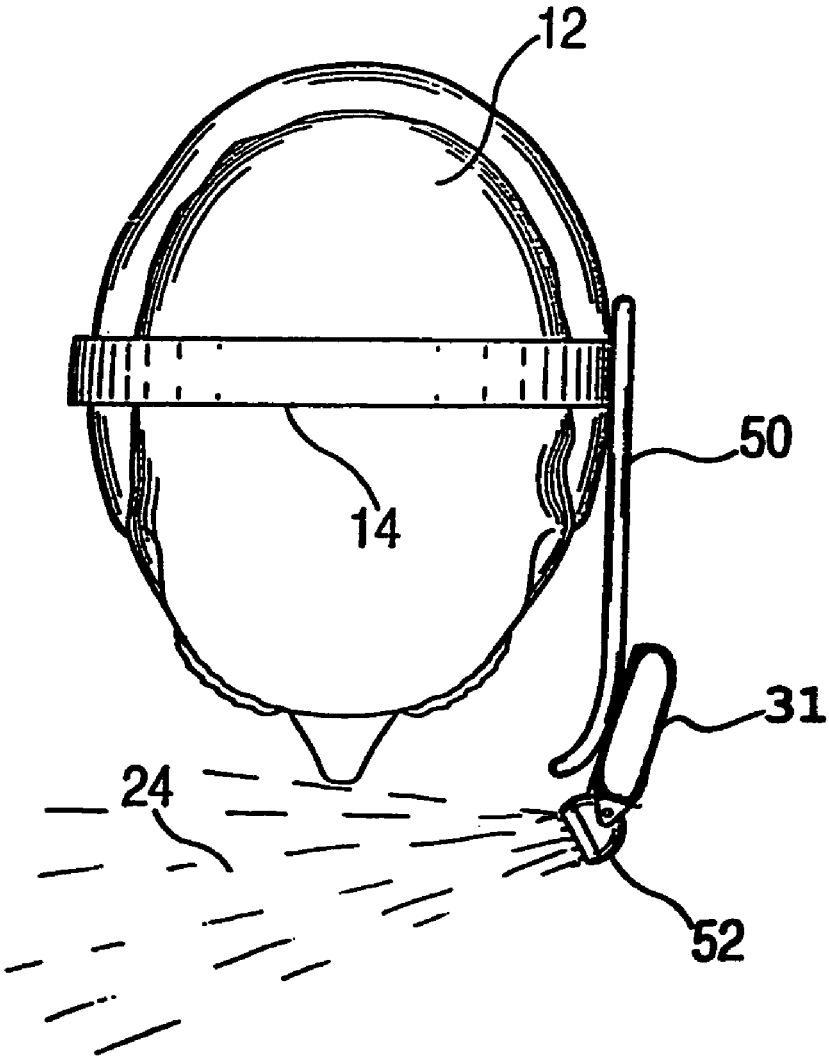
FIG. 8 is a top view of another embodiment of the present invention.

In FIG. 7, headset 14 is worn on head 12 of the user. Boom 50 is affixed to headset 14 at one end and fan 16 is affixed to the other end of boom 50. Fan 16 employs baffles or cowling 52 at its outlet to direct current of air 24 across the face of head 12. In FIG. 8, boom 50 is affixed at one end to headset 14 and is affixed at the other end to canister of compressed air 31.

The device of the present invention is intended for use by people with allergies, hay fever; people who want to breathe purified or cleaner air; people who do not want to breathe in cigarette, cigar or pipe smoke; people who want to avoid objectionable odors; people who want to avoid airborne contaminants when working in a contaminated area to include airborne illnesses and doctors or workers in hospitals as well as personnel that have to work with dangerous airborne chemicals and particles.

It will be understood that the claims are intended to cover all changes and modifications of the preferred embodiments of the invention herein chosen for the purpose of illustration which do not constitute a departure from the spirit and scope of the invention.

What is claimed is:

1. A portable device adapted to be worn by a human user for producing a flow of air across a face of the user comprising:

(a) a support means adapted to be worn by a user on a head, neck or shoulder; and (b) an adjustable air flow means for generating and directing a flow of air across a face of the user to divert airborne particles and chemicals away from the face of the user, said air flow means affixed to said support means thereby making the device portable, wherein said air flow means has a means for generating a flow of air, wherein said support means is head gear on which said directing means and said generating means are affixed, and wherein said support means has a boom, said boom being affixed at one end to said head gear, and said generating means affixed to the other end of said boom, said directing means being cowling attached to an outlet of said generating means.

2. The device of claim 1 wherein the flow of air across the face of the user is greater than or equal to 10 cubic feet per minute.

3. A device for producing a flow of air across a human face comprising:

(a) a means for generating a flow of air;

(b) a means for directing and adjusting said flow of air from said generating means across the face of said human to divert airborne particles and chemicals away from the face of said human; and (c) a support means adapted to be worn by a user and attached to said generating means thereby making said device portable, wherein said support means is head gear on which said directing means and said generating means are affixed, and wherein said support means has a boom, said boom being affixed at one end to said head gear, and said generating means affixed to the other end of said boom, said directing means being cowling attached to an outlet of said generating means.

4. The device of claim 3 wherein said generating means is a fan with a power source or a canister of air.

5. The device of claim 4 wherein said power source is a battery, a solar cell, or a winding spring.

6. The device of claim 3 wherein said head gear is a hat or a headset.

7. A device for producing a flow of air across a human face comprising:

(a) a headset adapted to be worn by a human;

(b) a fan mounted on said headset, said fan having an inlet and an outlet for air;

(c) tubing affixed to said outlet of said fan to direct and adjust a flow of air generated by said fan from the side of a face across the face of said human to divert airborne particles and chemicals away from the face of said human, wherein said fan and said tubing are affixed on said headset, and wherein said headset has a boom, said boom being affixed at one end to said headset, and said fan affixed to the other end of said boom, said tubing being cowling attached to an outlet of said fan.

8. The device of claim 7 further comprising a detector mounted to said tubing to detect particles or chemicals other than air having entered an area around and in said flow of air; and said detector producing a signal upon detecting the presence of said particle or chemical other than air.

9. The device of claim 7 further comprising an air conditioning unit affixed to said fan, said air conditioning unit being a dehumidifier, a radiation source or a fragrance source.

10. The device of claim 7 wherein said flow of air across said face is at an angle of less than 90° to more than 0° where 90° is normal to a plane across said face and 0° is parallel to said plane.

11. The device of claim 7 wherein said cowling is flexible cowling to allow for adjustment of said flow of air in direction and/or cross section.

12. The device of claim 7 wherein said cowling has one or more outlet jets to allow for adjustment of said air flow across said face.

13. The device of claim 12 wherein said outlet jets are adjustable to create one or more flows of air across said face.

* * * * *